United States Patent [19]

du Temple de Rougemont

[11] Patent Number: 4,606,292

[45] Date of Patent: Aug. 19, 1986

[54] APPARATUS FOR REEFING SAILS ON A BOAT AND SPECIALLY-DESIGNED BOOM INCLUDING SUCH AN APPARATUS

[75] Inventor: Christian du Temple de Rougemont, Paris, France

[73] Assignee: S.A.R.L. Isomat, France

[21] Appl. No.: 767,526

[22] Filed: Aug. 20, 1985

[30] Foreign Application Priority Data

May 6, 1985 [FR] France ..... 85 08450

[51] Int. Cl.[4] ..... B63H 9/10

[52] U.S. Cl. ..... 114/104; 114/39; 114/102; 114/89; 114/105

[58] Field of Search ..... 114/39.1, 89, 90, 102, 114/103, 104, 105, 112

[56] References Cited

U.S. PATENT DOCUMENTS 4,059,063 11/1977 Hood et al. ..... 114/102
4,365,572 12/1982 Stevenson, IV ..... 114/104
4,487,147 12/1984 Hoyt ..... 114/104

*Primary Examiner*—Trygve M. Blix
*Assistant Examiner*—Edwin L. Swinehart
*Attorney, Agent, or Firm*—Wegner & Bretschneider

[57] ABSTRACT

Apparatus for reefing sails on a boat and specially-designed boom including such an apparatus. The hollow boom extrusion houses at least one traveler block with two pulley wheels, over which pass the reefing leech line and the reefing luff line. The apparatus makes it possible to take one or more reefs in the sail simply by pulling on the free end of the reefing luff line which leads to the cockpit of the boat.

5 Claims, 5 Drawing Figures

APPARATUS FOR REEFING SAILS ON A BOAT AND SPECIALLY-DESIGNED BOOM INCLUDING SUCH AN APPARATUS

This invention relates to a boom-mounted apparatus for reefing the sails of a ship.

"Reefing", that is the manoeuvre required in heavy winds, which consists of reducing the total surface of a sail by taking one or more reefs in it, often is a very tricky operation. Furthermore, it always requires the presence of at least one crew member on the bridge, generally at the foot of the mast, to carry out manoeuvres such as hooking the reefing luff eye in a reefing hook at the end of the boom near the gooseneck or tightening the reefing luff line on the boom.

A variety of solutions have been proposed for facilitating this manoeuvre. One features a permanently-mounted reefing luff line running to the cockpit via a guide pulley at the foot of the mast. A similar system can be used for the reefing leech line; but in such an approach two reefing lines must be tightened from the cockpit, since the two lines are different lengths.

It has been proposed to combine the reefing leech line and the reefing luff line into a single line which would act simultaneously on the tack and the clew. The necessary pulley circuits and lines are so complicated, however, that tangles are hard to avoid. Thus in practice, a crew member must be on the bridge, at least to monitor the process and to intervene if necessary.

Furthermore, none of the reefing devices currently in use enable the yachtsman to take several reefs successively. Yet safety considerations in heavy winds may demand that sail surfaces be reduced by as much as 45 percent.

Clearly, no one up to now has devised a system for safely and rapidly carrying out, from the cockpit alone, all the manoeuvre associated with reefing a sail.

The present invention aims to fill this lacune through the use of an apparatus fitted to a hollow boom extrusion.

One feature of this invention is a traveller block mounted inside the boom and enjoying total mobility throughout most of the length of the boom. The block includes two pulley wheels, spaced longitudinally in the sense of the boom. The apparatus also comprises a reefing leech line acting on the reefing leech eye. This reefing leech line, of fixed length, is tied at one, or preferably both, ends to the boom. The line passes through the first pulley wheel of the traveller block; and it is the movement of this block toward the forward end of the boom (that is, the end closest to the mast) which tightens the reefing leech line. Finally, the apparatus also includes a reefing luff line which acts on the reefing luff eye. This reefing luff line enters the boom, passes through the second pulley wheel on the traveller block and exists the boom to be returned, by its free end to the cockpit. This line is the only one which must be tightened in order to reef the sail. By tightening, from the cockpit, the reefing luff line, the yachtsman can both move the reefing luff eye towards the boom and move the traveller block toward the forward end of the boom. This longitudinal movement of the traveller block in turn tightens the reefing leech line.

As will be seen from the following description, this device eliminates the risk that the reefing manoeuvre be impeded by twisted lines, thanks to the equalizing effect produced by the traveller block.

Preferably there should be one apparatus for taking the first reef in the sail and a second, identical, device placed symmetrically in the longitudinal axis of the boom, for taking a second reef in the sail. A third reef can be taken by rerigging the first device onto the reefing eye of the third reef band. As will be shown below, it is thus possible automatically to obtain a reduction in sail surface of some 45 percent.

The invention also covers a specially-designed boom featuring at least one such device for reefing sails.

The invention will become readily apparent by reading the detailed description below and examining the drawings, annexed, which represent non-limiting examples of various concrete forms which the said invention might take.

Figure 1:
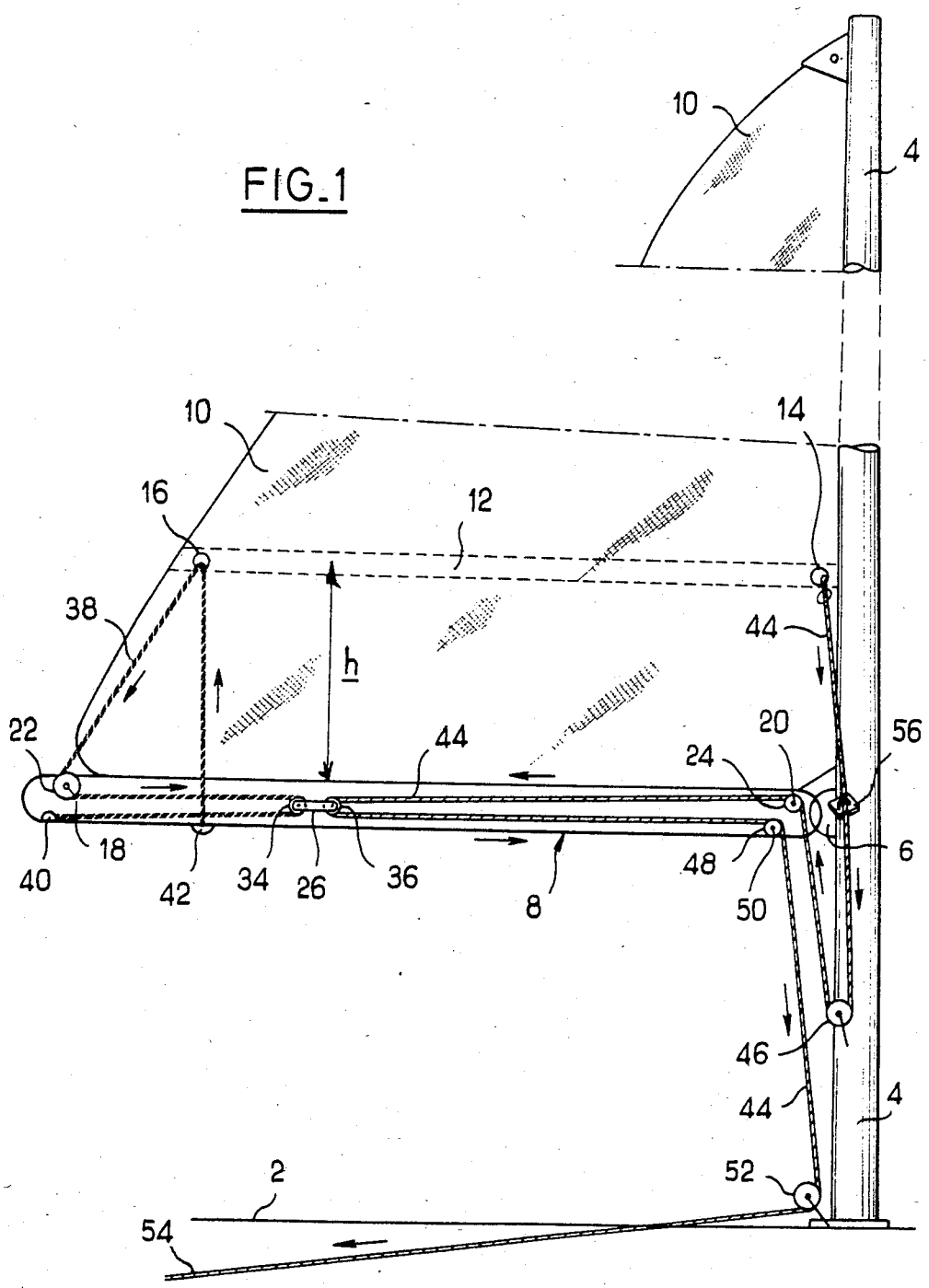
FIG. 1 is a diagram showing the device as described in the invention.

FIG. 1 shows a yacht bridge 2 on which is mounted a mast 4. Hinged to this mast by a gooseneck 6 is a hollow boom extrusion 8, to which a sail 10 is rigged. FIG. 1 shows only the first reef band 12, fitted with the usual reefing luff eye 14 and reefing leech eye 16.

Most shaped-metal hollow boom extrusions include an axle 18, 20 near each end of the boom. On each axle is mounted one or more pulley wheels to facilitate the movement of rigging during various routine manoeuvres. The device covered by the present invention uses one such pulley wheel 22, 24 at each end of the boom, for the return of the reefing leech line and the reefing luff line.

The device covered by the present invention comprises essentially a traveller block (26) which moves back and forth inside the hollow boom.

Figure 3:
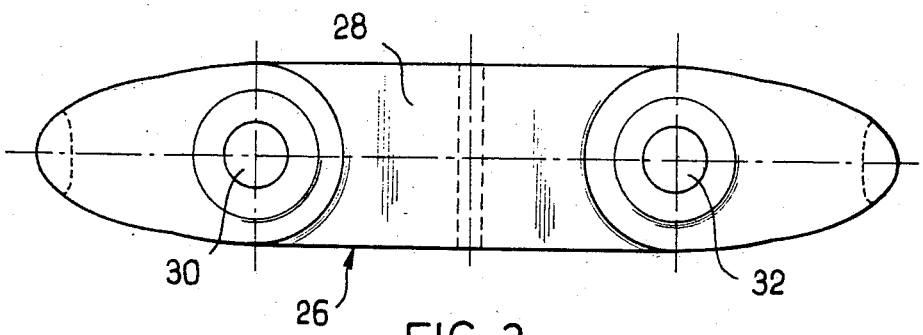
FIG. 3 is a side view of the traveller block.
Figure 4:
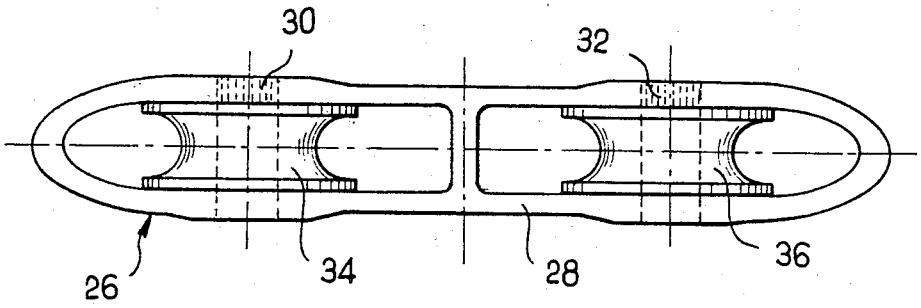
FIG. 4 is a top view of the traveller block.

FIGS. 3 and 4 show one possible design of this traveller block. It could include a housing (28) of a material such as lightweight alloy, smoothly shaped to allow free longitudinal movement through the boom. To further reduce friction, the housing could be coated in a plastic material or elastomer. Two axles 30, 32 cross the housing, each supporting a pulley wheel 34, 36. The pulley wheels are thus spaced apart from each other in the lengthwise sense of the boom.

Of course, any other design featuring an assembly of two pulley wheels also would be feasible.

The apparatus covered by the said invention includes a reefing leech line 38. One end of this line is attached to a fixed point 40, located inside the boom, near its after end (that is, the end farthest from the mast). The line passes around the after pulley wheel 34 of the traveller block, turns back toward the after end of the boom, and passes around the pulley wheel 22. All of this occurs inside the hollow boom. At this point the line exits the boom, goes through the reefing leech eye 16 and is tied to the boom at a fixed point 42 which is more or less on a vertical line with the reefing leech eye. As can be seen from the description, the reefing leech line 38 is of a fixed length and has no free ends.

As FIG. 1 clearly shows, only the movement of the traveller block 26 inside the boom toward the forward end can cause the reefing leech line to tighten. This tightening pulls the reefing leech eye down to the boom, thereby reefing the sail on its leech side.

Movement of the traveller block is caused by the yachtsman's tightening the reefing luff line. The mechanics of this manoeuvre are described below.

One end of the reefing luff line 44 is fixed to the reefing luff eye 14. The line then passes into the boom and across the pulley wheel 24 positioned at the boom's forward end. Preferably from the reefing luff eye the reefing luff line passes across a guide pulley 46 mounted on the mast before reaching the axle 20.

Inside the boom, the line 44 passes across the second pulley wheel 36, located on the forward end of the traveller block, then returns towards the forward end of the boom. There, it exits the boom, passing across a further pulley wheel or roller 48 which can be either mounted on an axle 50 crossing the boom or mounted on the axle 20 of the pulley wheel 24.

When it leaves the boom, the reefing luff line 44 passes through a guide pulley 52 mounted at the foot of the mast 4, and the free end 54 of the line is led into the cockpit (not shown). This line is the only reefing line which must be tightened in order to reef the sail.

As the arrows in FIG. 1 clearly show, tightening the reefing luff line 44 accomplishes two things: it brings the reefing luff eye 14 down to the boom, and it moves the traveller block 26 toward the forward end of the boom. As was seen in the preceeding description, this movement of the traveller block 26 in turn tightens the reefing leech line and pulls the reefing leech eye down to the boom. Thus, by manipulating a single line, it is possible to carry out the entire manoeuvre of reefing the sail (after slackening the mainsail's halyard, which is also led into the cockpit). During this latter manoeuvre, the ends of the reefing leech and luff lines 38, 44 circulate as shown by the arrows on FIG. 1.

Of course the opposite manoeuvre—chaking out a reef—can be performed with equal ease, from the cockpit.

It is important to note than in the device covered by this invention, the traveller block 26 also acts as a lifting beam or equalizer.

In effect, if there is a tangle in, for example, the reefing leech line 38, the traveller block 26 is not able to move freely toward the forward end of the boom. In such a situation, the traveller block then acts as a fixed point. The entire length of roping, pulled taut on the line 54, acts to pull the reefing luff eye 14 towards the gooseneck 6 where the eye is stopped by a threader 56, fixed to the mast, through which the reefing luff line runs.

The resulting blockage causes the reefing luff line 44 to pull only on the traveller block 26 with resulting demultiplication ratio of the pulley block formed by the two bits of reefing luff line 44 in the boom. The blockage thereby pulls the traveller block toward the forward end of the boom, tightening the reefing leech line 38. Thus tangles do not hinder the reefing manoeuvre.

Figure 2:
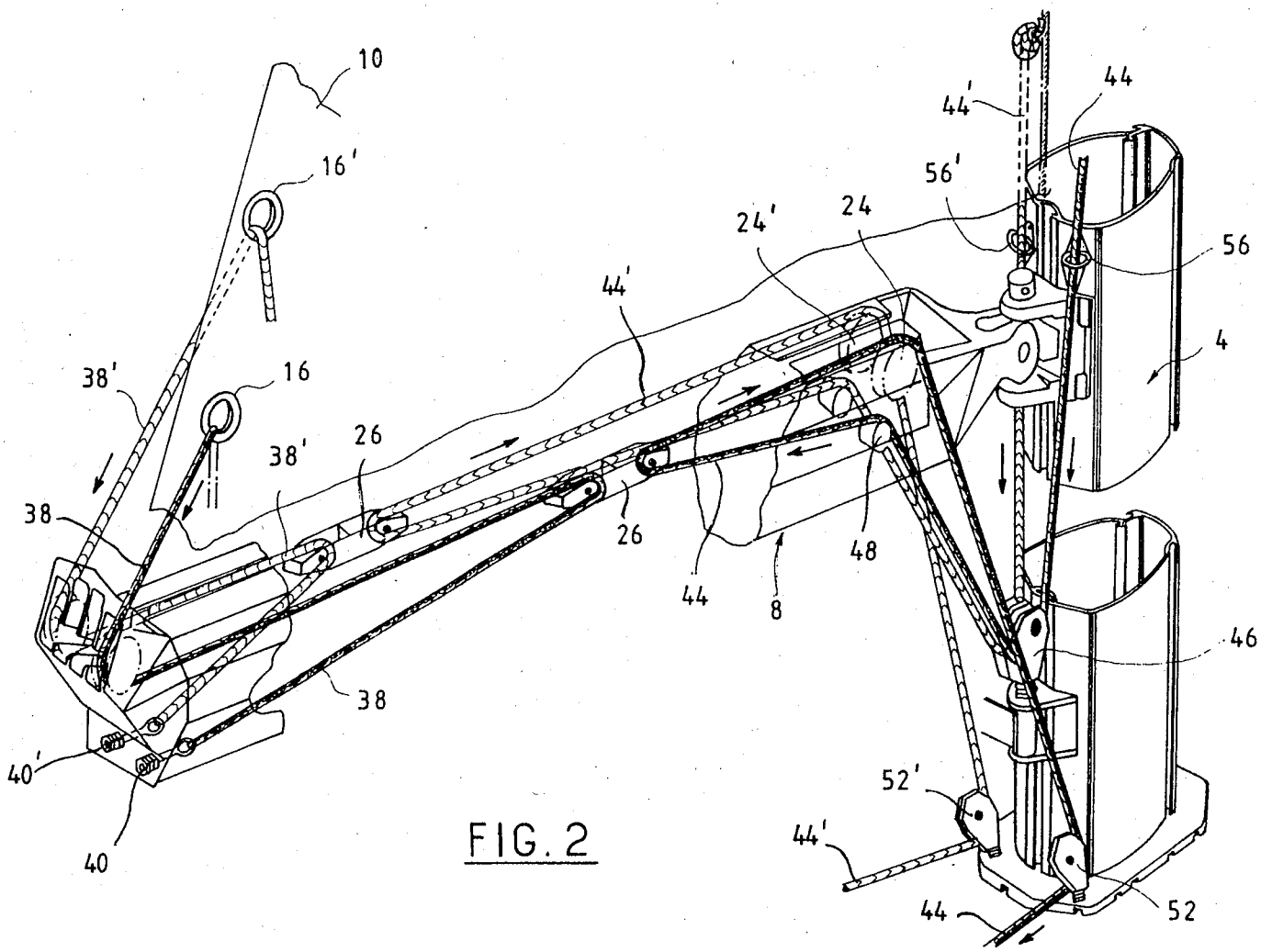
FIG. 2 is an exploded view showing details of the same device, as arranged for successive reefing manoeuvres.

FIG. 2 is an exploded diagram of the device covered by the said invention for taking successive reefs in a sail.

To take several reefs in the sail, two sets of devices, identical to the one described above and schown in FIG. 1, are placed side by side in the appropriate positions. Elements of the second apparatus are indicated as "prime". The reefing leech line 38 of the first apparatus acts on the reefing leech eye 16 of the first reef band, while the reefing leech line 38' of the second apparatus acts on the reefing leech eye 16' of the second reef band. (This second reef band is higher up on the sail, of course, as that shown in FIG. 2). Both traveller blocks 26, 26' can move about freely inside the boom without hindering each other.

To take a first reef, the yachtsman tightens the reefing luff line 44. Once the sail is reefed, he takes up the slack in the reefing luff line 44' and the latter line is ready to take a second reef. Of course it would be possible to add a third, identical, device to take a third reef in the sail. But it is simpler, once the second reef is taken, to strip the reefing leech and luff lines 38, 44 from the reefing leech and luff eyes 16, 14 of the first reef and thread them through the corresponding eyes 16'', 14'' of the third reef (see FIG. 5).

It will now be shown that the amplitude of movement of the traveller block(s) 26, 26' inside the boom permits three successive reefs and makes it possible to reduce sail surface by 45 to 60 percent. This was not possible with devices proposed up to now.

Figure 5:
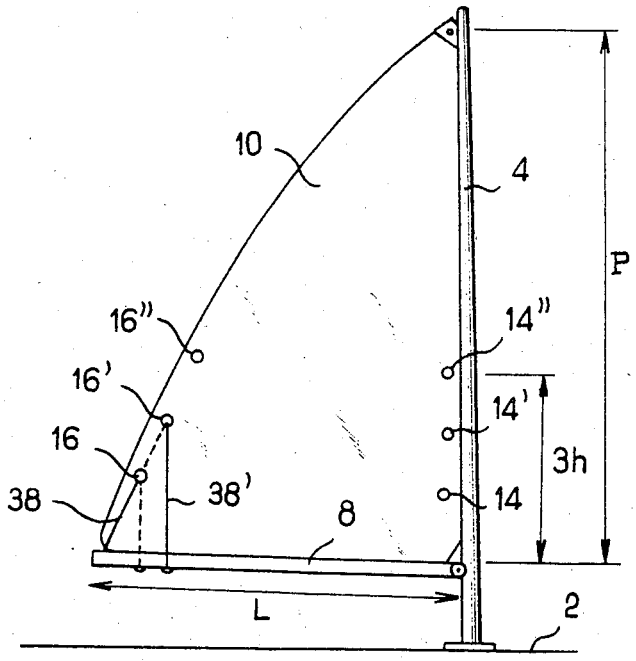
FIG. 5 shows a sail equipped with three reef bands.

It can be seen form FIG. 1 that if the height of a reef is h, the displacement of traveller block 26 toward the forward end of the boom (which corresponds to the manoeuvre of reefing a sail) is equal roughly to h or ($h \times 1.5$), according to the amount of stretch in the sail (P/L ratio, see FIG. 5). Thus the longer the boom, the greater the height of reef that can be taken.

Given a sail stretch of 3, the movement of the traveller block (26) along the whole length of the boom would make it possible to reduce, in two reefs, sail height P by 30 percent (for a sail surface reduction of about 50 percent). Generally speaking on cruising yachts, sail height P is reduced by 25 percent in two reefs.

To reduce sail further, it is necessary to take a third reef. The apparatus covered by the said invention makes it possible to reduce P by about 60 percent in three reefs, assuming sail stretch of 3, and by about 80 percent with sail stretch of 2.5.

FIG. 1 shows the reefing leech line 38 as running through the reefing leech eye (16), with its end tied to a fixed point 42 on the boom 8. This arrangement presents two advantages: First, the reefing leech eye 16 is pulled by line 38 simultaneously toward both the end of the boom (pulley 22 and the fixed point 42). The eye 16 is thereby pulled tight against the boom, thus maintaining the correct shape in the reefed sail. Second, passing the reefing leech line 38 through the reefing leech eye 16 creates an effect of demultiplication which in turn decreases the amount of work required to pull the eye 16 down to the boom. this demultiplication effect doubles the amplitude of the traveller block's movement, but this increase in the displacement effect is not problematic, as was shown above.

It would be possible, of course, to tie the end of the reefing leech line 38 to the eye 16, but that would mean foregoing the two advantages described above.

Similarly, FIG. 1 shows the reefing luff line 44 as being fixed directly to the reefing luff eye 14. But to obtain an effect of demultiplication, it would also be possible to run the line 44 through the eye 14 and fix the end of this line to the boom as was done for the reefing leech line 38.

I claim:

1. An apparatus for reefing the sail of a ship, rigged on a hollow boom extrusion, comprising:

(i) a traveller block, freely moveable inside the boom along at least most of the boom's length, said traveller block including two pulley wheels one at each end of the traveller block;

(ii) a reefing leech line consisting of a fixed length of roping, at least one end of which is tied to a fixed point near the after end of the boom, said roping passing afterwards to the interior of the boom, across the after-end pulley wheel of the traveller block, then across a pulley wheel mounted at the after end of the boom before reaching a reefing leech eye of the sail;

(iii) a reefing luff line which has one accessible free end, said line entering the boom via a guide element placed at the forward end of the boom passing across the forward-end pulley wheel of the traveller block and exiting the boom, across a second pulley wheel on the forward end of the boom before reaching a reefing luff eye of the sail.

2. The apparatus of claim 1, wherein the free and accessible end of the reefing luff line is led into the ship's cockpit and constitutes the sole line which must be tightened in order to reef the sail.

3. The apparatus of claim 1 or 2, for the taking of successive reefs, which comprises two traveller blocks circulating inside the hollow boom extrusion, two reefing leech lines and two reefing luff lines.

4. The apparatus of claim 1, wherein the other end of the reefing leech line is tied to a fixed point of the boom and the said line goes through the reefing leech eye.

5. The apparatus of claim 1, wherein the reefing luff line has one end tied to the reefing luff eye and that this line passes through two guide pulleys mounted on the mast.

* * * * *

UNITED STATES PATENT AND TRADEMARK OFFICE

CERTIFICATE OF CORRECTION

PATENT NO. : 4,606,292

DATED : August 19, 1986

INVENTOR(S) : Christian du Temple de Rougemont

It is certified that error appears in the above-identified patent and that said Letters Patent are hereby corrected as shown below:

Change "[30] Foreign Application Priority Data

May 6, 1985 [FR] France ... 85 08450"
to -- [30] Foreign Application Priority Data June 5, 1985 [FR] France ... 85 08450 --

Signed and Sealed this

Twenty-fifth Day of November, 1986

*Attest:*

DONALD J. QUIGG

*Attesting Officer* *Commissioner of Patents and Trademarks*